United States Patent [19]

Kouchich et al.

[11] 4,006,443

[45] Feb. 1, 1977

[54] COMPOSITION RESISTOR WITH AN INTEGRAL THERMAL FUSE

[75] Inventors: Allan V. Kouchich, Milwaukee; Robert Marshall, Mequon, both of Wis.

[73] Assignee: Allen-Bradley Company, Milwaukee, Wis.

[22] Filed: Sept. 11, 1975

[21] Appl. No.: 612,313

[52] U.S. Cl. ..... 338/215; 29/613; 219/517; 317/9 R; 317/9 AC; 337/296; 338/273; 338/275

[51] Int. Cl.[2] ..... H01C 13/00

[58] Field of Search ..... 338/200, 215, 223–226, 338/273, 275, 276, 334; 337/163, 296; 219/517; 317/9 R, 9 AC; 29/610, 613, 623

[56] References Cited

UNITED STATES PATENTS

| | | | |
|---|---|---|---|
| 3,238,490 | 3/1966 | Thomson | 338/273 |
| 3,887,893 | 6/1975 | Brandt et al. | 338/273 X |

*Primary Examiner*—C. L. Albritton
*Attorney, Agent, or Firm*—Quarles & Brady

[57] ABSTRACT

A composition resistor incorporates a thermal fuse inert preferably positioned at its center. The insert includes a fuse link which under normal conditions provides electrical continuity between lead wires extending from each end of the resistor. If a current overload occurs, the heat generated by the resistance material raises the temperature at the center of the resistor to the melting point of the fuse link and the fuse link opens circuit before the organic constituents of the resistor begin to decompose or ignite.

15 Claims, 16 Drawing Figures

COMPOSITION RESISTOR WITH AN INTEGRAL THERMAL FUSE

BACKGROUND OF THE INVENTION

The field of the invention is electronic components, and particularly, fixed electrical resistors of the carbon composition type and methods of manufacturing the same.

Carbon composition resistors have been manufactured and widely used for many years. As disclosed in U.S. Pat. No. 1,835,267, issued to Lynde Bradley in 1931, early carbon composition resistors were large and bulky by today's standards. Despite this, however, they found wide application over the alternative forms of wire wound resistors and thin film resistors because they were more rugged and less susceptible to forming an open circuit during use. Also, after suitable manufacturing techniques had been developed, the composition resistors proved to be less expensive than the alternatives and a single standard size could be used through a range of resistance values from a few ohms to many megohms.

The art has continuously advanced throughout the ensuing years. For example, responding to the demand for smaller resistors, structures and manufacturing techniques were developed, such as those disclosed in U.S. Pat. Nos. 2,261,916; 2,271,774 and 2,302,564 which issued in 1941 and 1942. With the advent of miniaturized vacuum tubes and the transistor in the following decades, the demand for more rugged and even smaller 1/10 and 1/4 watt carbon composition resistors arose with the result that structures such as those disclosed in U.S. Pat. No. 3,238,490 issued to Homer Thomson in March, 1966, were developed.

The continued commercial success of the carbon composition resistor throughout the years is attributable in large measure to its continued lower cost and, therefore, any proposed improvement in existing carbon composition resistor structures must allow a cost advantage over alternative forms to be commercially viable. As evidenced by the above cited patents, past improvements in the structure of the carbon composition resistor have often been accompanied by corresponding advances in their method of manufacture to enable this continued cost advantage.

The flammability of components used in electronic applications has been of increasing concern to the electronics industry in recent years. Recognizing the need for flame resistant components, a number of resistance structures have been proposed to replace conventional resistors. One such proposed approach for achieving a flame resistant resistor is to construct it solely from thermally inert materials using wire as the resistance element. Another approach is to coat an otherwise flammable resistor with a nonorganic protective coating. Although many of these proposed structures have indeed substantially reduced the flammability of the component, they are not entirely satisfactory. First, the cost of many presently available flame resistant resistors is prohibitive for many applications where carbon composition resistors are presently used. In addition, although such flame resistant resistors may not themselves ignite when overloaded, the heat generated by the overload may affect the circuit board to which they are mounted or adjacent components.

In U.S. Pat. No. 3,887,893 issued to Ivan Brandt and Theodore von Alten on June 3, 1975, a cermet fixed resistor is disclosed which includes a thermal fuse connected in circuit with the resistance material. When the temperature of the substrate upon which the thermal fuse is mounted reaches a preset level, the thermal fuse opens circuit and the overload current is interrupted. The resistor is thus open circuited before the ignition temperature of any of its constituents or surrounding components is reached.

SUMMARY OF THE INVENTION

The present invention relates to an improved resistor, and more particularly, to a resistor which includes a thermal fuse which is molded into the center of the resistor where it provides electrical continuity under normal operating conditions. When the temperature at the center of the resistor reaches a preset value, however, the thermal fuse opens circuit to terminate the flow of current through the resistor and it thereby serves to prevent the resistor from reaching an excessive temperature.

A general object of the invention is to provide a carbon composition resistor which will open circuit under predetermined current overload conditions. The thermal fuse is preferably inserted at the center of the resistor where the temperature is at a maximum. The thermal fuse includes a fuse link which provides electrical continuity at normal operating temperatures, but which melts at a preselected temperature to interrupt current flow through the resistor. The composition of the fuse link is selected to provide a fusing point which is above the maximum temperature encountered during the manufacture of the resistor, but below the temperature at which the organic constituents of the resistor begin to decompose.

Another general object of the invention is to provide a resistor structure which is compatible with existing manufacturing methods and machinery. The conventional carbon composition resistor is made by depositing the resistance powder in a circular cylindrical sleeve, or jacket, inserting the leads into the ends of the sleeve, and then molding the resulting structure into an integral mass. The fused resistor of the present invention is made by inserting a disc shaped thermal fuse into the sleeve and depositing the resistance powder on each side of the insert. The remainder of the manufacturing process is unaltered.

A more specific object of the invention is to minimize the manufacturing costs of a carbon composition resistor having a thermal overload fuse. The thermal fuse insert is an integral unit which is manufactured and tested separately. It includes a pair of electrodes which are supported by and spaced from one another by an insulating disc. A through path is formed in the disc and a fuse link is disposed therein and provides electrical continuity between the electrodes. The thermal fuse insert is tested for continuity prior to insertion into the resistor sleeve thus assuring an ultimate resistor yield rate substantially the same as that of conventional carbon composition resistors.

Another specific object of the invention is to provide a thermal fuse for a carbon composition resistor which does not significantly effect the temperature coefficient of resistance, the voltage coefficient of resistance, or the other important resistor parameters.

Another object of the invention is to provide a carbon composition resistor with a thermal fuse which has definite fusing characteristics. The melting point of the fuse link and the geometry of the fuse insert determines the fuse characteristics. Therefore, by judiciously selecting one of the well known fuse materials or alloys thereof, the desired fusing temperature can be reliably obtained using economical mass production methods. Because the thermal fuse insert is positioned at the center of the resistor it is responsive primarily to the heat generated by the current flow through the resistor and is less responsive to external heat sources of a transient nature. Therefore, the magnitude of the overload current necessary to open the fuse element is predictable and quite consistent for any particular structure.

Yet another object of the invention is to provide a thermal fuse insert which is applicable to resistors of various sizes. The insert may be scaled in size to fit within various sized resistor bodies including the standard one-quarter watt size which is used in large quantities in consumer and industrial products.

The foregoing and other objects and advantages of the invention will appear from the following description. In the description reference is made to the accompanying drawings which form a part hereof, and in which there is shown by way of illustration preferred embodiments of the invention. Such embodiments do not necessarily represent the full scope of the invention and reference is made to the claims herein for interpreting the breadth of the invention.

DESCRIPTION OF THE PREFERRED EMBODIMENTS

Figure 1:
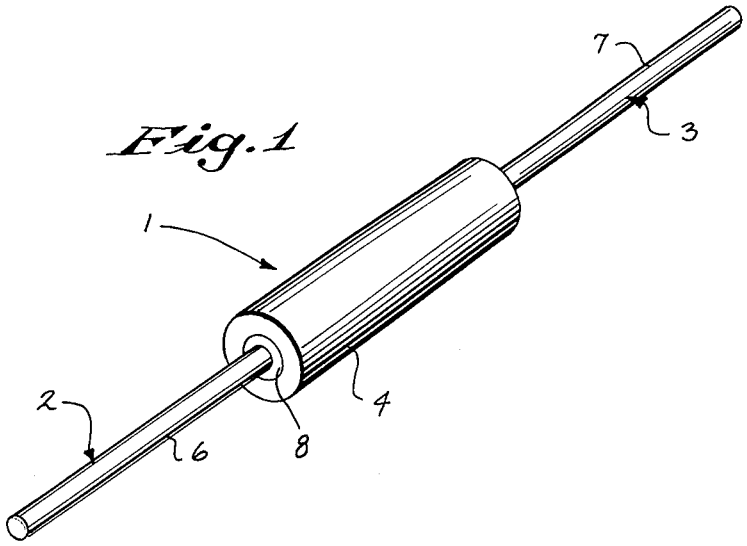
FIG. 1 is a perspective view of a fixed resistor made according to the present invention.
Figure 2:
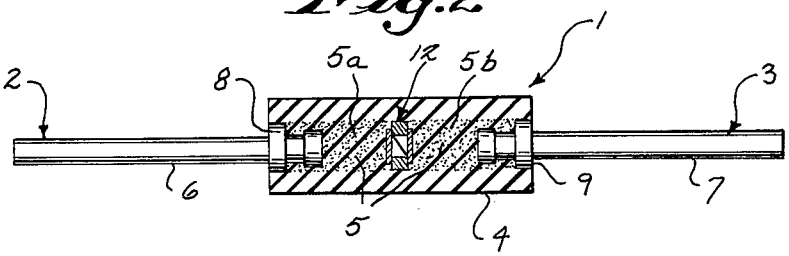
FIG. 2 is a view in cross section of the resistor of FIG. 1.
Figure 3:
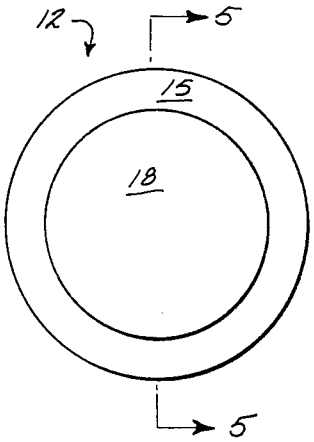
FIG. 3 is a front elevation view of a thermal fuse insert which forms part of the resistor of FIG. 1.
Figure 4:
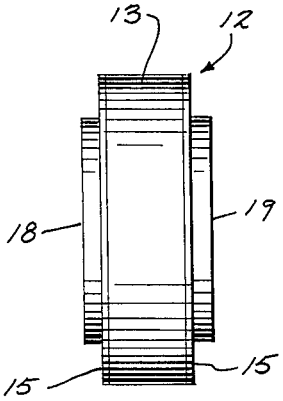
FIG. 4 is a side elevation view of the thermal fuse insert.
Figure 5:
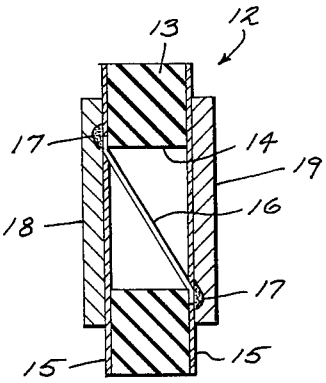
FIG. 5 is a view in cross section of the thermal fuse insert.
Figure 6:
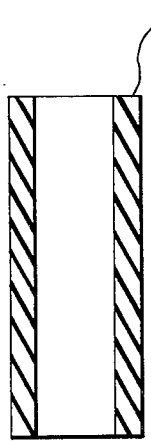
FIGS. 6–10 are schematic illustrations of the invented resistor during successive stages of manufacture.
Figure 7:
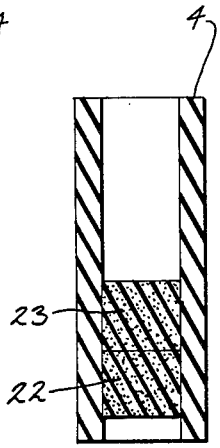

Referring to FIGS. 1 and 2, the resistor of the present invention includes a circular cylindrical body portion 1 and a pair of terminal electrodes 2 and 3 which extend from the ends of the body 1. The body 1 is comprised of a molded insulating sleeve 4 that is made from a suitable thermal-setting insulating composition, such as one consisting of a phenol-aldehyde resin binder, quartz filler, and a lubricant such as stearic acid. A suitable mix for the sleeve material is as follows:

| | | |
|---|---|---|
| Phenol-aldehyde resin (such as No. 175 Durez resin) | lbs | 3 |
| Ground quartz | lbs | 12 |
| Lubricant | gms | 136 |

This material is mixed by rolling on a hot mixing roll until it acquires the proper plasticity. After cooling, the sheets are crushed and ground to a powder suitable for loading into a preformed die in which the sleeve 4 is molded.

Contained within the tubular sleeve 4 is a carefully measured quantity of moldable resistor material 5. The resistor material consists of conductor particles dispersed in an insulating thermal-setting binder, such as may be made from phenol-adelhyde resin binder, quartz filler, calcined carbon black, and a lubricant. An example of a suitable resistance material is as follows:

| | | |
|---|---|---|
| Phenol-aldehyde resin (such as No. 175 Durez resin) | lbs | 4 |
| Ground quartz | lbs | 10 |
| Calcined carbon black | lbs | 2 |
| Lubricant | gms | 136 |

This material is mixed by rolling on a hot mixing roll until it acquires the proper plasticity. After cooling, the sheets are crushed and ground to a powder suitable for loading into the insulating sleeve 4.

The terminal electrodes 2 and 3 are similar to those described in the above cited U.S. Pat. No. 3,238,490. They are made of copper and include a lead wire 6 and 7 and an enlarged head 8 and 9. The terminal electrodes 2 and 3 are coated with a 90–10 solder and their heads 8 and 9 are embedded in the ends of the body 1 in electrical contact with the resistor material 5. An electrically conductive path is thus formed between the terminal electrodes 2 and 3 through the resistor material 5.

Referring particularly to FIGS. 2–5, a thermal fuse insert 12 is disposed within the sleeve 4 and located substantially equidistant from its ends. The insert 12 is disc shaped and its circular cylindrical outer surface engages the interior surface of the sleeve 4 to divide the resistor material 5 into two sections 5*a* and 5*b*. The insert 12 is thus contained within the conductive path between the terminal electrodes 2 and 3.

The thermal fuse insert 12 includes a circular cylindrical substrate 13 made of an electrically insulating material such as sintered alumina. The substrate 13 is punched from 0.023 inch thick green alumina tape and fired typically at 1200° C. A central circular opening, or through path 14, is formed through the substrate 13 and conductive layers 15 are deposited on its opposing sides. The conductive layers 15 are formed by a silver paste, such as No. 6730 manufactured by DuPont, which is fired at 850° C. for twenty minutes. The diameter of the through path 14 is 0.034 inch and the outside diameter of the substrate 13 is determined by the diameter of the sleeve 4 as follows:

| RATING (WATTS) | SLEEVE LENGTH (INCHES) | SLEEVE DIAMETER (INCHES) | SUBSTRATE DIAMETER (INCHES) |
|---|---|---|---|
| ¼ | 0.250 ± 0.015 | 0.090 ± 0.008 | 0.044 |
| ½ | 0.375 ± 0.031 | 0.140 ± 0.008 | 0.086 |
| 1 | 0.562 ± 0.031 | 0.225 ± 0.008 | 0.140 |
| 2 | 0.688 ± 0.031 | 0.312 ± 0.008 | 0.220 |

To provide electrical continuity between the two resistor sections 5*a* and 5*b* under normal operating conditions, a fuse link 16 is disposed within the through path 14 and connected to the conductive layers 15 by a conductive epoxy 17. The fuse link 16 is made by rolling fuse alloy stock into a sheet having a thickness of from 0.001 inch to 0.002 inch and cutting it into ribbons 0.1 inch wide. Circular copper terminals 18 and 19 are attached by use of conductive epoxy or solder to the opposing sides of the substrate 13 and they overlie a substantial portion of the layers 15. The terminals 18 and 19 insure good electrical continuity between the thermal fuse insert 12 and the resistance sections 5*a* and 5*b*.

The fuse material used depends primarily upon the particular fusing temperature desired, which in turn determines the power point at which fusing occurs. The fusing temperature must be above the molding and annealing temperatures encountered during the manufacture of the resistor after the thermal fuse insert 12 is inserted. As will be described below, the hot molding process used to form the resistor of the preferred embodiment requires that the fusing temperature be above 420° F.

The following fusing characteristics were obtained on ½ watt resistors when excessive currents were applied. Depending on the magnitude of the applied overload current, the fuse links opened circuit in from 5 to 30 seconds to a value in excess of 10 megohms.

| Resistance | Applied Power (Watts) | Fuse Link Material |
|---|---|---|
| 700 | 7.00 | 10%Sn/90%Pb |
| 1000 | 4.80 | 10%Sn/90%Pb |
| 1300 | 3.25 | 10%Sn/90%Pb |
| 1200 | 3.25 | 95%Sn/0.5%Sb |
| 1300 | 3.50 | 95%Sn/0.5%Sb |
| 2000 | 3.20 | 95%Sn/05%Sb |

Figure 11:
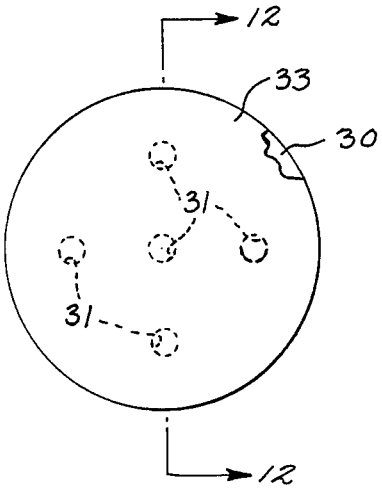
FIG. 11 is an elevation view with part cut away of a second preferred embodiment of the thermal fuse insert.
Figure 12:
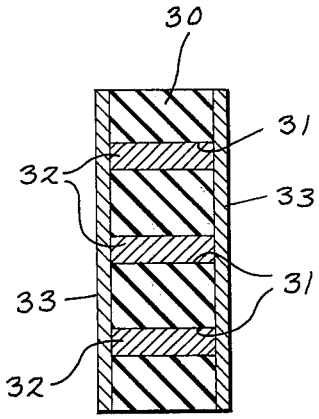
FIG. 12 is a view in cross section of the thermal fuse insert of FIG. 11 taken along the plane 12—12.

Other thermal fuse insert structures are also possible. Referring particularly to FIGS. 11 and 12, a second preferred embodiment of the thermal fuse insert is shown and includes a circular cylindrical substrate 30 made of alumina, steatite, polyimide, or other suitable electrically insulating material. A set of five through paths 31 are formed through the substrate 30 and communicate with its opposing sides. These are filled with a fuse material such as a cadmium-silver alloy, to form fuse links 32. Terminals 33 are formed on the opposing sides of the substrate 30 by depositing a conductive layer of silver-glass mixture such as DuPont Silver Paste 8706 and firing the same. These terminals 33 serve to provide electrical continuity between the fuse links 32 and the adjacent resistance powder.

Figure 13:
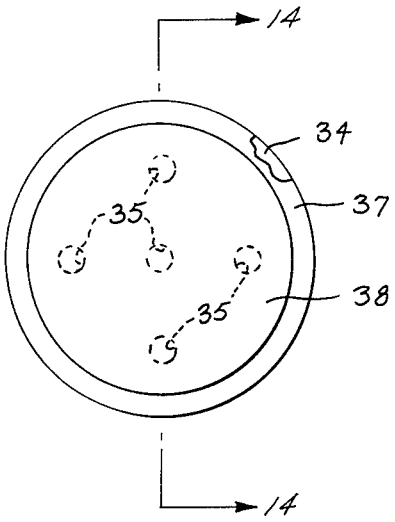
FIG. 13 is an elevation view with part cut away of a third preferred embodiment of the thermal fuse insert.
Figure 14:
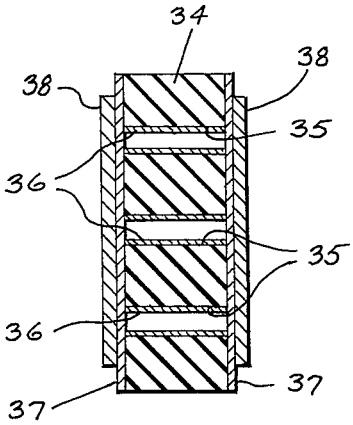
FIG. 14 is a view in cross section of the thermal fuse insert of FIG. 13 taken along the plane 14—14.

Referring particularly to FIGS. 13 and 14, a third preferred embodiment of the thermal fuse insert is shown and also includes a circular cylindrical substrate 34 having five through paths 35 formed therethrough. Fuse links 36 are formed in the through paths 35 by depositing a layer of cadmium on the walls thereof as described in the above cited U.S. Pat. No. 3,887,893. Conductive layers 37 are deposited on opposing sides of the substrate 34 using a silver-glass mixture and circular copper terminals 38 are attached thereto using a conductive epoxy. When the power point of the resistor is reached, the fuse link layers 36 melt as a result of the heat conducted by the substrate 34. The fuse link material migrates by surface preferred wetting to the opposing conductive layers 37 and the conductive path between the opposing copper terminals 38 is thus open circuited.

Figure 15:
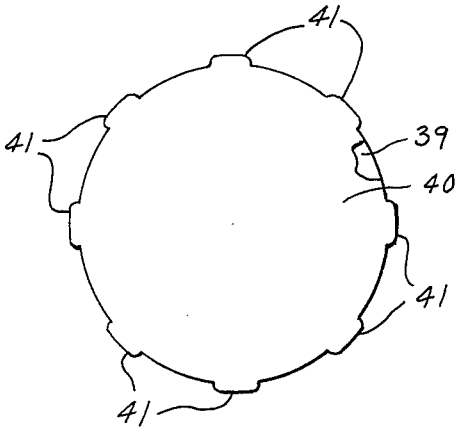
FIG. 15 is an elevation view with part cut away of a fourth preferred embodiment of the thermal fuse insert.
Figure 16:
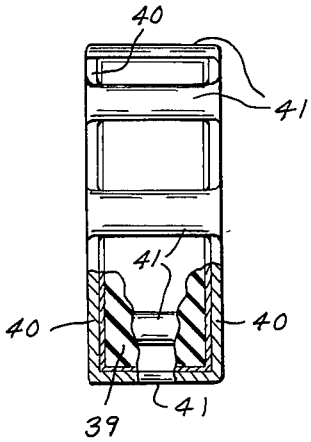
FIG. 16 is a side view with parts cut away of the thermal fuse insert of FIG. 15.

Referring to FIGS. 15 and 16, a fourth preferred embodiment of the thermal fuse insert is shown in which the through paths are formed around the periphery of the substrate. More specifically, a circular cylindrical substrate 39 is formed as described above, and the opposing sides thereof are electroded with a silver-glass paste to form terminals 40. Fuse links 41 are formed as a set of eight bands which are disposed equidistantly around the periphery of the substrate 39 and which extend between opposing sides thereof to provide electrical continuity between the terminals 40. The fuse links 41 are formed by first applying a sensitizing material to points on the surface of the substrate where the fuse links 41 are to be formed and on the exposed surfaces of the terminals 40. A layer of cadmium is then deposited to a thickness of 0.00025 to 0.00050 inches on the sensitized areas. For more specific description of this process and the materials used therein, reference is made to the above cited U.S. Pat. No. 3,887,893. When the power point of the resistor is reached, the heat conducted through the substrate 39 and surrounding sleeve 4 melts the fuse links 41 which open circuit by surface preferred wetting.

Figure 8:
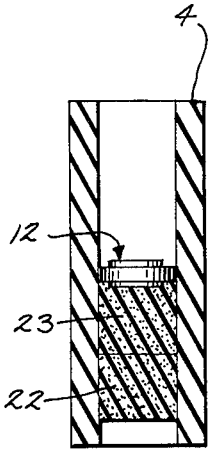
Figure 9:
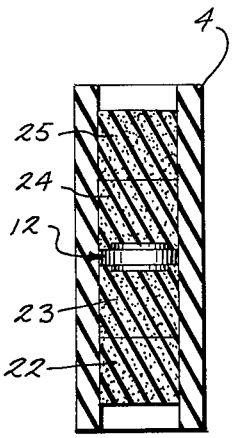
Figure 10:
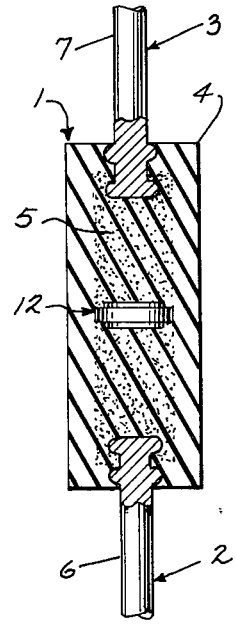

Referring particularly to FIGS. 6–10, the present invention lends itself to mass production techniques. The sleeve 4 is prepared within a heated die block at approximately 300° F. and after molding it remains in the heated die block in an upright position. A first measured quantity of resistance material is loaded into the sleeve 4 and is compacted into a semi-solid mass 22 and a second measured quantity is loaded on top thereof and compacted into a semisolid mass 23. The thermal fuse insert 12 is deposited on top of the mass 23 using a vibratory bowl feeder and is pressed in place as shown in FIG. 8. Successive third and fourth measured quantities of resistance material are then loaded into the sleeve 4 and compacted to form the semisolid masses 24 and 25. The preform is then removed from the heated die and, as described in the above cited U.S. Pat. No. 3,238,490, is placed in another heated die where the terminal electrodes 2 and 3 are pressed into place causing the resistance material 5 and sleeve 4 to flow into their final configuration. The application of further heat at approximately 340° F. to 410° F. forms an integral molded piece as shown in FIG. 10 with the thermal fuse insert 12 embedded at its center. Existing machinery for manufacturing conventional carbon composition resistors can thus be used throughout the process.

It should be apparent to those skilled in the art that many variations can be made in the above described preferred embodiments of the invention without departing from the spirit thereof. For example, although the invention lends itself to the hot molding process described above, it can also be embodied in resistors made by well known cold molding processes. Also, although the sleeve may be a premolded element into which the fuse insert and resistance powder are inserted, it may also take the form of a protective, insulating coating which is formed around a premolded resistor with thermal fuse insert.

I claim:

1. In a resistor having a sleeve made of an electrically insulating material which is filled with a carbon composition resistance material and having a pair of terminal electrodes disposed at its ends to provide a conductive path therebetween through the resistance material, the improvement therein comprising a thermal fuse insert which is disposed within said sleeve and within the conductive path formed by said resistance material, said thermal fuse insert including: a substrate made of an electrically insulating material; a pair of electrodes disposed on opposite sides of said substrate; a through path formed in said substrate between said electrodes; and a fuse link disposed within said through path and electrically connected to said electrodes to provide electrical continuity therebetween at normal operating temperatures, said fuse link being responsive to the heat generated by the resistance material when current flows therethrough to open circuit when a predetermined temperature is reached.

2. The resistor as recited in claim 1 in which said thermal fuse insert is disposed within said sleeve substantially equidistantly from its ends and substantially equal portions of said resistance material is disposed on each side of said thermal fuse insert in electrical contact with one of said electrodes and one of said terminal electrodes.

3. The resistor as recited in claim 2 in which said sleeve is circular cylindrical in shape and has openings at each of its ends into which the terminal electrodes are received and retained, and said substrate has a circular cylindrical surface which mates with the inner surface of said sleeve.

4. A carbon composition resistor, the combination comprising:

a circular cylindrical sleeve molded from an electrically insulating material;

a thermal fuse insert disposed within said sleeve and positioned substantially equidistant from its ends;

a first resistor section molded from a carbon composition resistance material and disposed within said sleeve to one side of said thermal fuse insert;

a second resistor section molded from a carbon composition resistance material and disposed within said sleeve to the other side of said thermal fuse insert; and a pair of terminal electrodes fastened to the ends of said sleeve to provide electrical connection to said first and second resistor sections.

5. The carbon composition resistor as recited in claim 4 in which said thermal fuse insert includes a substrate which electrically insulates said resistor sections from one another and a fuse link which is disposed in a through path in said substrate and which provides electrical continuity between said resistor sections at normal operating temperatures.

6. The carbon composition resistor as recited in claim 5 in which electrical continuity between said fuse link and said resistor sections is maintained through a pair of electrodes which are disposed on opposing surfaces of said substrate.

7. A carbon composition resistor, the combination comprising:

a sleeve molded from an electrically insulating material;

an insert disposed within said sleeve and having a pair of spaced electrodes which are directed towards each end of the sleeve;

a first resistor section molded from a carbon composition resistance material and disposed within said sleeve to one side of said insert and in electrical contact with one of said electrodes;

a second resistor section molded from a carbon composition resistance material and disposed within said sleeve to the other side of said insert and in electrical contact with said other electrode; and a pair of terminal electrodes fastened to the ends of said sleeve to provide electrical connection to said first and second resistor sections.

8. The carbon composition resistor as recited in claim 7 in which said sleeve is circular cylindrical in shape and said insert includes a substrate having a circular cylindrical outer surface which mates with the inner surface of said sleeve to physically separate said first and second resistor sections from one another.

9. The carbon composition resistor as recited in claim 8 in which said insert is disposed substantially equidistantly from the ends of said sleeve.

10. The carbon composition resistor as in claim 7 in which said insert includes a substrate formed from an electrically insulating material which is disposed between said spaced electrodes and provides support therefor.

11. The carbon composition resistor as in claim 10 in which a through path is formed in said substrate and means for conducting electrical current is disposed therein and provides electrical continuity between said spaced electrodes.

12. In a resistor having a pair of terminal electrodes which are electrically connected to one another by a molded resistance material, the improvement therein comprising a thermal fuse insert which is disposed within said molded resistance material, substantially midway between said terminal electrodes, said thermal fuse insert including a fuse link which supports electrical continuity between said terminal electrodes at normal operating temperatures, but which melts at a preselected temperature to open circuit.

13. The improvement as recited in claim 12 in which said fuse link is supported by a substrate which physically divides said molded resistance material into two sections disposed on opposite sides thereof and said fuse link provides electrical continuity between said resistor sections.

14. The improvement as recited in claim 13 in which said fuse link extends through an opening in said substrate and electrically connects with electrodes which are disposed on said opposite sides of said substrate.

15. The improvement as recited in claim 14 in which said electrodes cover each end of said opening in said substrate.

* * * * *

UNITED STATES PATENT OFFICE
CERTIFICATE OF CORRECTION

PATENT NO. : 4,006,443
DATED : February 1, 1977
INVENTOR(S) : Allan V. Kouchich et al It is certified that error appears in the above-identified patent and that said Letters Patent are hereby corrected as shown below:

| | |
|---|---|
| Abstract, line 2 | "inert" should be -- insert -- |
| Column 5, line 44 | "95% Sn/0.5% Sb" should be -- 95% Sn/05% Sb -- |
| Column 5, line 45 | "95% Sn/0.5% Sb" should be -- 95% Sn/05% Sb -- |
| Column 6, line 53 | "semisolid" should be -- semi-solid -- |
| Column 6, line 58 | "semisolid" should be -- semi-solid -- |

Signed and Sealed this
Thirtieth Day of May 1978

[SEAL]

Attest:

RUTH C. MASON
Attesting Officer

LUTRELLE F. PARKER
Acting Commissioner of Patents and Trademarks